United States Patent [19]

Hashizume

[11] Patent Number: 4,913,124

[45] Date of Patent: Apr. 3, 1990

[54] IGNITION APPARATUS FOR AN INTERNAL COMBUSTION ENGINE

[75] Inventor: Atsushi Hashizume, Hyogo, Japan

[73] Assignee: Mitsubishi Denki Kabushiki Kaisha, Tokyo, Japan

[21] Appl. No.: 337,796

[22] Filed: Apr. 13, 1989

[30] Foreign Application Priority Data

Apr. 13, 1988 [JP] Japan ..... 63-92144

[51] Int. Cl.[4] ..... F02P 11/02

[52] U.S. Cl. ..... 123/631; 123/424

[58] Field of Search ..... 123/414, 418, 424, 631

[56] References Cited

U.S. PATENT DOCUMENTS

| | | | |
|---|---|---|---|
| 4,080,940 | 3/1978 | Fuzzell et al. | 123/631 X |
| 4,198,941 | 4/1980 | Oishi | 123/424 X |
| 4,226,219 | 10/1980 | Olmstead | 123/424 |
| 4,633,834 | 1/1987 | Takeuchi et al. | 123/424 |

FOREIGN PATENT DOCUMENTS

| | | | |
|---|---|---|---|
| 2728859 | 1/1978 | Fed. Rep. of Germany | 123/631 |
| 0115468 | 7/1984 | Japan | 123/424 |

*Primary Examiner*—Willis R. Wolfe

*Attorney, Agent, or Firm*—Sughrue, Mion, Zinn, Macpeak and Seas

[57] ABSTRACT

An ignition apparatus for an internal combustion engine started by rotation of the crank shaft in one direction by the driving of a starter. An ignition coil and an ignition plug connected to the ignition coil are provided to generate ignition sparks at a predetermined interval of time. A sensor senses first and second predetermined angular positions in one rotation of the crank shaft and the output of the sensor changes between first and second levels every time each of the angular positions is sensed. The ignition coil is energized during a period when the output of the sensor is at the first level and de-energized to generate a spark at the ignition plug at the time when the output of the sensor changes from the first level to the second level. In the event of the current flowing through the starter being cut off and the period during which the output of the sensor is hold at the first level exceeding a predetermined length of time, the ignition coil is controlled so that its condition is held unchanged or so that the flow of current therethrough gradually decreases, thereby preventing any spark from being generated at the ignition plug.

19 Claims, 6 Drawing Sheets

IGNITION APPARATUS FOR AN INTERNAL COMBUSTION ENGINE

BACKGROUND OF THE INVENTION

1. Technical Field of the Invention

This invention relates to an ignition apparatus for an internal combustion engine arranged in such a way that no ignition spark is generated when the crank shaft of the engine is rotated in the reverse direction during starting of the engine.

2. Description of the Prior Art

When starting an internal combustion engine, an ignition switch is normally operated to drive a starter which rotates the crank shaft. The ignition coil is energized for a part of the period of one revolution of the crank shaft and is then de-energized. Upon de-energization of the ignition coil, an ignition spark is generated at the ignition plug to explode the mixed gas thereby maintaining the rotation of the crank shaft.

In a conventional ignition apparatus, a sensor is provided for sensing two specific angular positions in one revolution of the crank shaft for achieving the energization and de-energization of the ignition coil. When the sensor senses one of the angular positions the ignition coil is energized, and when the other angular position is sensed the coil is de-energized to generate a spark at the ignition plug.

FIG. 1 is a circuit diagram of an example of such a conventional ignition apparatus. In this figure, a sensor 1 for sensing angular positions of a rotary member, such as, for example, a crank shaft CS, of an internal combustion engine EN generates, in synchronism with the rotation of the crank shaft CS, an output which falls from a high level to a low-level at a first angular position $\theta_1$ for every rotation of the crank shaft CS and another output which rises from the low-level to the high level at a second angular position $\theta_2$. Thus the output of the sensor 1 is low from $\theta_1$ to $\theta_2$ (first state) and high from $\theta_2$ to $\theta_1$ (second state). The output terminal of the sensor 1 is connected to the base electrode of a first transistor 2, the emitter electrode of which is, in turn, connected to the ground, the collector electrode of which being connected to the positive end of a battery 3 through a resistor 4. The collector output of the first transistor 2 is connected to the base electrode of a second transistor 5. The emitter electrode of the second transistor 5 is grounded and the collector electrode thereof is connected to the positive end of the battery 3 through the primary winding of an ignition coil 6. Connected between the output end of the secondary winding of the ignition coil 6 and the ground is an ignition plug 7.

FIG. 2 shows waveforms of an output voltage a of the sensor 1, a collector voltage b of the first transistor 2, a collector voltage c of the second transistor 5 and a secondary output voltage d of the ignition coil 6. The operation of the ignition apparatus of FIG. 1 will be described below with reference to FIG. 2.

When the sensor 1 senses the first angular position $\theta_1$ of the crank shaft CS at the time $t_1$ the output of the sensor 1 goes from the high level to the low level and thus the first transistor 2 turns OFF, making the second transistor 5 ON (conductive) and thereby allowing a current to flow through the primary winding of the ignition coil 6. The sensor 1 senses the second angular position $\theta_2$ of the crank shaft CS at the time $t_2$. At this time, the output of the sensor 1 goes from the low level to the high level to turn the first transistor 2 ON. Accordingly, the second transistor 5 is turned OFF (or cut off) to stop the flow of current through the primary winding of the ignition coil 6 so that a secondary high output is generated in the ignition coil 6 to generate a spark at the ignition plug 7. At subsequent times $t_3$ and $t_4$ similar operations are performed. From the time $t_3$ at which the sensor 1 senses the first angular position $\theta_1$, a current flows through the primary winding of the ignition coil 6, and at the time $t_4$ at which the sensor 1 senses the second angular position $\theta_2$, a spark is generated. From the time $t_5$, a current flows through the primary winding of the coil 6, as described above. Since the second angular position $\theta_2$ is approximately at the compression top dead center of the engine EN, the compression pressure within the cylinder of the engine EN is increased as the crank shaft CS rotates in the forward direction from $\theta_1$ to $\theta_2$. If the driving force of the engine EN is insufficient, however, it may happen that the momentum of the crank shaft CS is overcome by the compression pressure, the crank shaft CS fails to pass over the top dead center, and rotates back toward the bottom dead center. Let's suppose that, before the sensor 1 senses the second angular position $\theta_2$, the crank shaft CS begins to be rotated in the reverse direction at the time $t_6$. The above-described rotation will hereafter be referred to as the forward rotation and the rotation in the direction opposite thereto is referred to as the reverse rotation. Then, the crank shaft CS passes through the first angular position $\theta_1$ in the reverse direction at the time $t_7$. This results in the fact that the output of the sensor 1 at the time $t_7$ is reversed from the low level to the high level. This is an operation reverse to that which takes place at the time $t_5$ at which the crank shaft CS passes through the first angular position $\theta_1$ and the output of the sensor 1 goes from the high level to the low level. Since the output of the sensor 1 goes to the high level at the time $t_7$, the first transistor 2 is turned ON and thus the second transistor 5 is turned OFF. At the time $T_7$, therefore, the current flowing through the primary winding of the ignition coil 6 is cut off to allow a spark to be generated at the plug 7. This spark would encourage the possibility of reverse rotation of the crank shaft CS, leading to a danger of engine damage.

SUMMARY OF THE INVENTION:

The present invention aims, as its general object, to solve the above-described problems of the conventional ignition apparatus for an internal combustion engine.

Another object of the invention is to provide an ignition apparatus for an internal combustion engine arranged in such a way that no spark is generated at the ignition plug when the rotary member of the engine is reversely rotated.

The present invention is directed to an ignition apparatus for an internal combustion engine that is started by the rotation of a rotary member in one direction by virtue of the driving force of a starter. The apparatus comprises an ignition coil and an ignition plug which is connected to the ignition coil to generate ignition sparks at predetermined intervals of time. The ignition apparatus has in one of its aspects an angle sensing means for sensing first and second angular positions of the rotary member, the output of the sensing means being changed between the first and second levels every time each of the angular positions is sensed.

An ignition control means coupled to the angle sensing means and the ignition coil is provided to energize the ignition coil during the period of time when the output of the angle sensing means is at the first level and to de-energize the ignition coil to generate a spark at the ignition plug at the time when the output of the angle sensing means goes from the first level to the second level.

A monitoring means is provided for monitoring whether or not a current is flowing through the starter and for generating an output when the current is cut off.

A measuring means is coupled to the angle sensing means for measuring a period during which the output of the angle sensing means in held at the first level and for generating an output when the above period exceeds a predetermined length of time.

Further, an ignition preventing means is provided for controlling the ignition coil in response to the outputs of the monitoring means and the measuring means so that no ignition spark is generated at the ignition plug, thereby preventing the generation of any spark at the plug when the rotary member rotates reversely.

The angle sensing means may have an angular position sensor and the ignition control means may include a transistor connected in series to the ignition coil. The transistor is turned ON for the period when the output of the sensor is at the first level and OFF for the period when the output of the sensor is at the second level.

The measuring means may include a capacitor which starts to be charged at the time when the sensor is turned from the second level to the first level and is discharged at the time when the sensor is turned from the first level to the second level, and a comparator for comparing the charging voltage of the capacitor with a reference voltage. The magnitude of the reference voltage may be set such that the charging voltage of the capacitor exceeds the reference voltage when said predetermined length of time elapses, and the comparator generates an output when the charging voltage exceeds the reference voltage.

In one embodiment, the ignition preventing means has an energization means for holding the ignition coil in the energized condition regardless of the output from the sensor when both the outputs of both the monitoring means and the comparator are generated.

The energization means may comprise an AND gate for receiving the outputs from the comparator and the monitoring means and a flip-flop for holding the output of the AND gate. The output of the AND gate is coupled to the junction between the collector electrode of the transistor and the ignition coil to hold the ignition coil in the energized condition in response to the output of the flip-flop.

The outputs of the flip-flop and the sensor may be supplied to the transistor through the OR gate.

In another embodiment, the ignition preventing means has a current reducing means for gradually reducing the flow of current through the ignition coil in response to the fact that the comparator generates an output and that the monitoring means detects the reverse rotation of the starter.

The current reducing means may include a capacitor and resistor connected in series between the collector and base electrodes of the transistor. The capacitor of the series circuit is charged and discharged corresponding to the ON and OFF states of the transistor when the current is flowing through the starter. The series circuit constitutes a negative feedback circuit between the collector and the base electrodes to slowly shift the transistor from ON to OFF.

The ignition apparatus of the present invention comprises according to another aspect a sensor means for sensing first and second angular positions of the rotary member. The output of the sensor means is changed between first and second levels every time the respective angular positions are sensed.

Coupled between the sensor means and the ignition coil is a switching means which is turned ON to energize the ignition coil during the period when the output of the sensor means is at the first level and turned OFF to de-energize the ignition coil for generating an ignition spark at the ignition plug when the output of the sensor goes from the first level to the second level.

A monitoring means monitors whether or not a current is flowing through the starter and generates an output when the flow of current is cut off.

Also coupled to the sensor means is a detecting means for generating an output when detecting the fact that the period during which the output of the sensor means is held at the first level exceeds a predetermined length of time.

A holding means is also provided for holding the ignition coil in the energized condition in response to the outputs of the monitoring means and the detecting means, thereby preventing a spark from being generated at the ignition plug when the rotary member is reversely rotated.

The detecting means may include a capacitor adapted to initiate the charging at the time when the output of the sensor means changes from the second level to the first level and the discharge at the time when the output changes from the first level to the second level, and a comparator for comparing the charging voltage of the capacitor with a reference voltage. The magnitude of the reference voltage is set such that the charging voltage of the capacitor exceeds the reference voltage when the above stated predetermined length of time has elapsed, and the comparator generates an output when the charging voltage exceeds the reference voltage.

In one embodiment, the holding means may comprise an AND gate for receiving the outputs of the comparator and the monitoring means, and a flip-flop for holding the output of the AND gate. The output of the flip-flop is coupled to the junction between the output terminal of the switching means and the ignition coil for holding the latter in the energized condition in response to the output of the flip-flop.

In another embodiment, the holding means may comprise an AND gate for receiving the outputs of the comparator and the monitoring means, and a flip-flop for holding the output of the AND gate. The output of the flop-flop is supplied through an OR gate to an input terminal of the switching means to hold the latter in the ON condition in response to the output of the flip-flop.

The ignition apparatus of the present invention comprises according to a further aspect a sensor means for sensing first and second angular positions, the output of the sensor means being changed between first and second levels every time the respective angular positions are sensed.

Coupled between the sensor means and the ignition coil is a switching means which is turned ON to energize the ignition coil during the period when the output of the sensor means is at the first level and is turned OFF to de-energize the coil for generating a spark at the ignition plug at the time when the output of the sensor means goes from the first level to the second level.

A monitoring means monitors whether or not any current is flowing through the starter and generates an output when such flow of current is cut off.

Also coupled to the sensor means is a detecting means for generating an output when it detects the fact that the period during which the output of the sensor means is held at the first level exceeds a predetermined length of time.

Further a de-energization means is provided for gradually changing the ignition coil from the energized condition to the de-energized condition in response to the outputs of the monitoring means and the detecting means to prevent a spark from being generated at the ignition plug when the rotary is reversely rotated.

The detecting means may include a capacitor adapted to initiate the charging at the time when the output of the sensor means changes from the second level to the first level and the discharge at the time when the output changes from the first level to the second level, and a comparator for comparing the charging voltage of the capacitor with a reference voltage. The magnitude of the reference voltage is set such that the charging voltage of the capacitor exceeds the reference voltage when the above stated predetermined length of time has elapsed, and the comparator generates an output when the charging voltage exceeds the reference voltage.

The de-energization means may have a current reducing circuit operable to gradually reduce the flow of current through the ignition coil in response to the fact that the comparator is generating the output and that the monitoring means has detected the reverse rotation of the starter.

The current reducing means may include a capacitor and a resistor connected in series between the output and input terminals of the switching means. The capacitor of the series circuit is charged and discharged in response to the ON and OFF states of the switching means during the period when a current is flowing through the starter. The series circuit constitutes a negative feedback circuit between the input and output terminals of the switching means and is adapted to slowly turn the switching means from ON to OFF when the flow of current through the starter is cut off.

As described above, according to the present invention no ignition spark is generated when reverse rotation of the internal combustion engine occurs, so a safe apparatus that will no cause engine damage can advantageously be provided.

The above-mentioned and other objects and features of the present invention will be better understood by reviewing the following detailed description with reference to the accompanying drawings illustrating preferred embodiments by way of an example.

Figure 1:
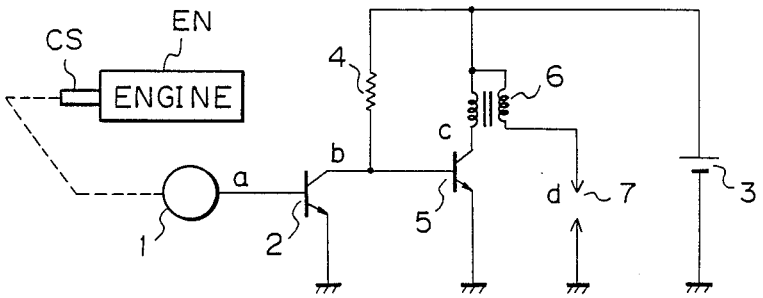
Fig. 1 ( PRIOR ART )
FIG. 1 is a schematic diagram showing the arrangement of a conventional ignition apparatus for an internal combustion engine.
Figure 2:
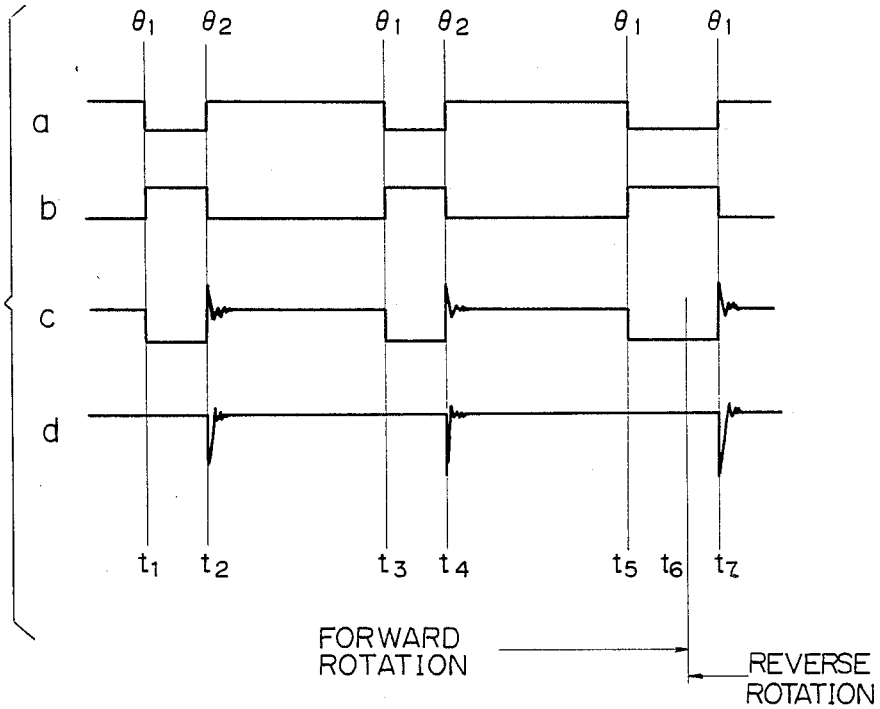
Fig. 2 ( PRIOR ART )
FIG. 2 shows signal waveforms in relation to the timing of outputs from the main portions of the arrangement of the ignition apparatus of FIG. 1.
Figure 3:
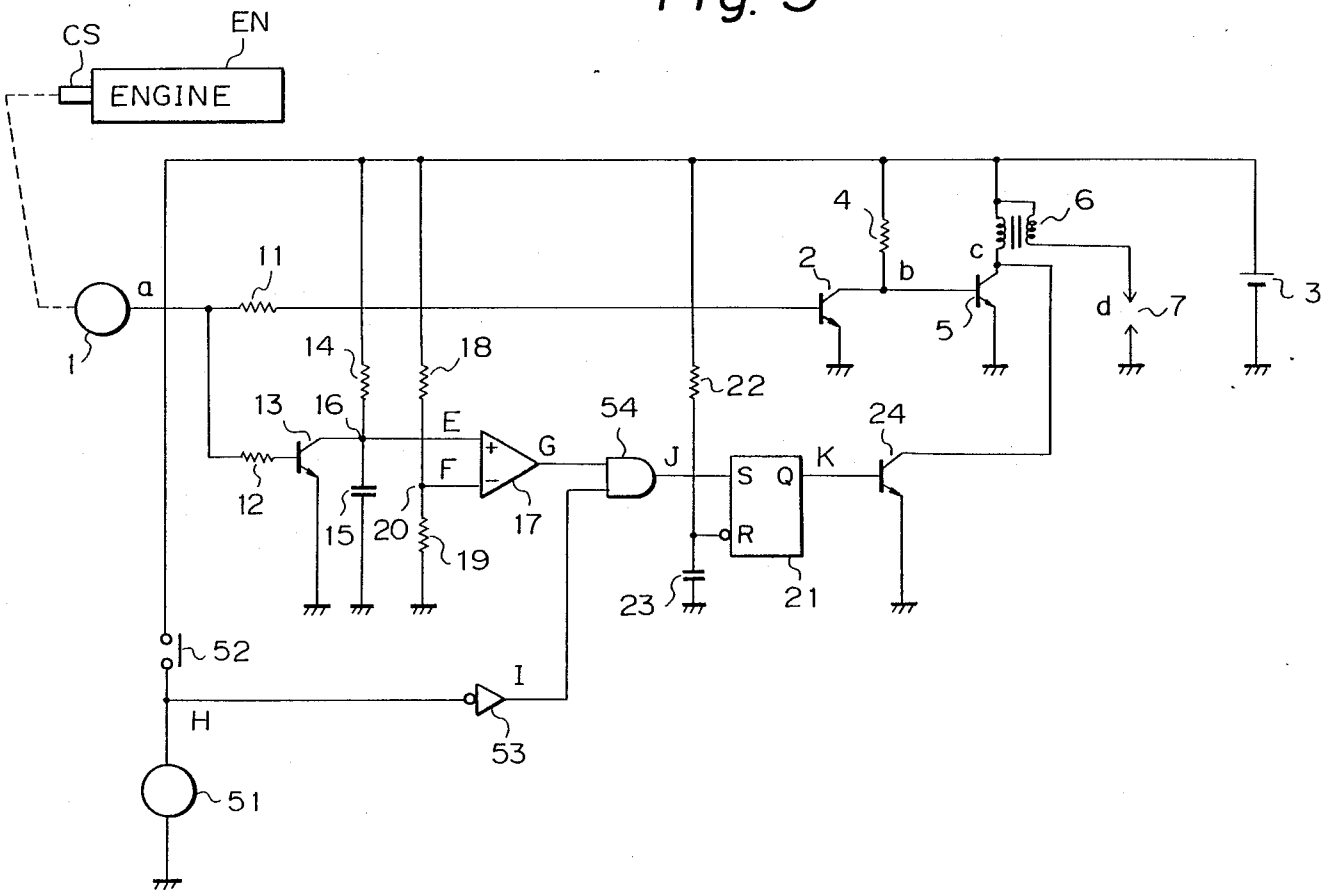
FIG. 3 is a circuit diagram showing the arrangement of an embodiment of an ignition apparatus in accordance with the present invention.

DESCRIPTION OF THE PREFERRED EMBODIMENTS:

FIG. 3 is a circuit diagram showing an embodiment of an ignition apparatus for an internal combustion engine in accordance with the present invention. In this drawing, elements and components similar to those of the ignition apparatus of FIG. 1 are referred to by the same reference signs and numerals, and no further description of such components will be given here.

In FIG. 3, a starter 51 for starting an internal combustion engine EN is connected at one end to the positive terminal of the battery 3 through a switch 52 and the other end of the starter 51 is grounded. As for starting the engine EN, when the switch 52 is turned ON, the starter 51 is energized during the period of the switch 52 being turned ON. The junction between the starter 51 and the switch 52 is connected to an input port of an inverter 53 from which an inverted signal is supplied to one input port of two-input type AND gate 54.

The output of the sensor 1 is connected through a resistor 11 to the base electrode of the first transistor 2, and the junction between the sensor 1 and the resistor 11 is connected through a resistor 12 to the base electrode of a third transistor 13. The emitter electrode of the third transistor is grounded and the collector electrode thereof is connected through a resistor 14 to the positive terminal of the battery 3 and is grounded through a capacitor 15.

The junction 16 between the resistor 14 and the capacitor 15 is connected to the non-inverted input port of a comparator 17, the inverted input port of which is connected to the junction 20 between two resistors 18 and 19 connected in series between the positive terminal of the battery 3 and the ground. The output port of the comparator 17 is connected to the other of the input ports of the AND gate 54. The AND gate 54 is operable such that when both of the inputs are at the high level, the output becomes high, while in other input conditions the output is at the low level. The output port of the AND gate 54 is connected to the set input terminal S of a flip-flop 21 and is adapted to set the latter only under a predetermined condition. The reset input terminal R of the flip-flop 21 is connected to the junction between a resistor 22 and a capacitor 23 which are connected in series between the positive terminal of the battery 3 and the ground. The flip-flop 21 is reset when the power source is activated. The output terminal Q of the flip-flop 21 is connected to the collector electrode of the second transistor 5 through a fourth transistor 24.

Figure 4:
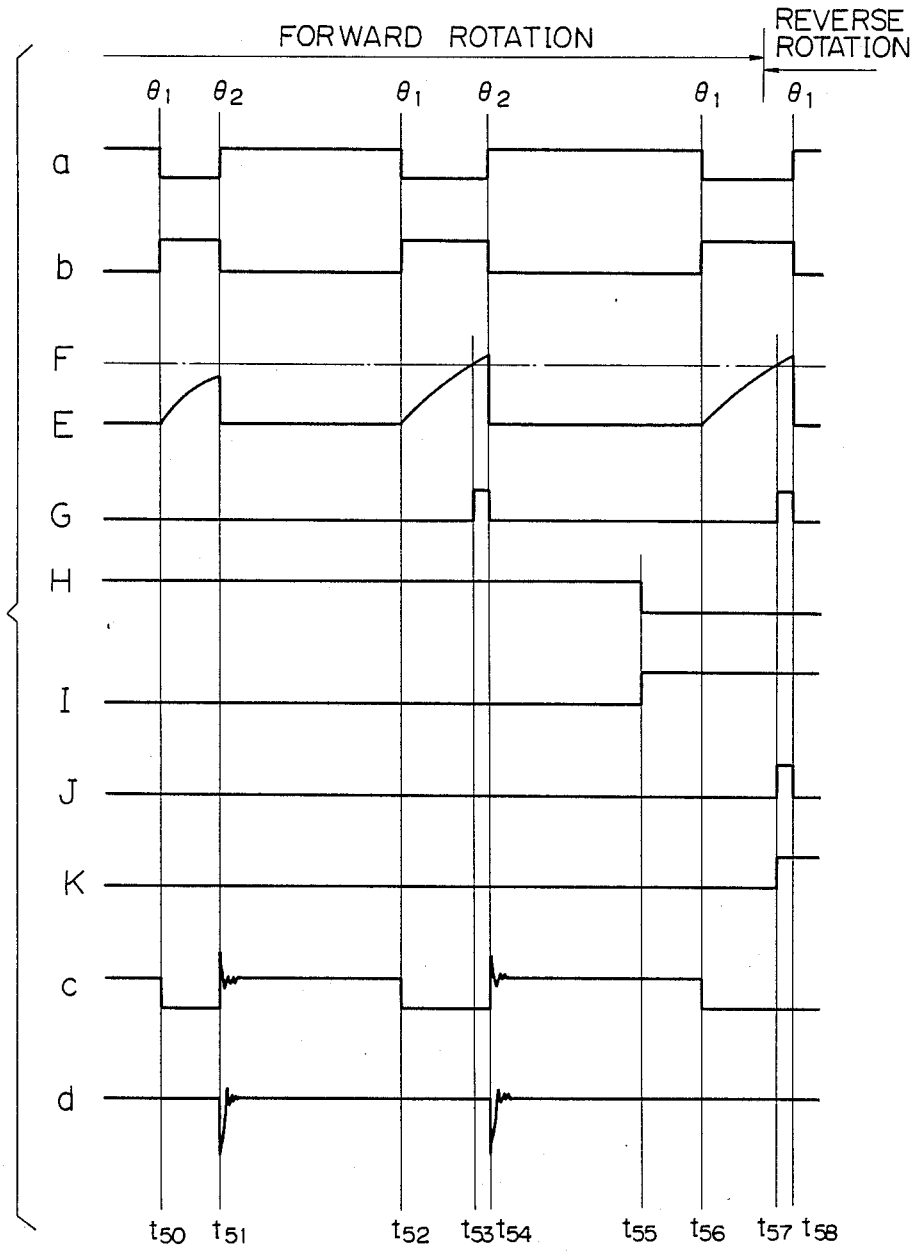
FIG. 4 shows signal waveforms in relation to the timing of outputs from the main portions of the ignition apparatus having the arrangement shown in FIG. 3.

FIG. 4 shows voltage waveforms of various portions of the ignition apparatus of FIG. 3, i.e., the output voltage a of the sensor 1, the collector output voltage b of the first transistor 2, the collector output voltage c of the second transistor 5, the voltage d generated at the ignition plug 7, the voltage E at the junction 16, the voltage F at the junction 20, the output voltage G of the comparator 17, the terminal voltage H of the starter 51, the output voltage I of the inverter 53, the output voltage J of the AND gate 54 and the output voltage K of the flip-flop 21.

The operation of the ignition apparatus of FIG 3 will be described below with reference to FIG. 4.

When a driver turns on the switch 52 for starting the engine EN, the starter 51 is energized during the period when the switch 52 is ON and the crank shaft CS of the engine EN is rotated in the forward direction. When the sensor 1 senses the first angular position $\theta_1$ of the crank shaft at the time $t_{50}$, the output of the sensor 1 goes to the low level which serves to turn off the first transistor 2 and turn on the second transistor 5, allowing a current to flow through the primary winding of the ignition coil 6. On the other hand, since the output of the sensor 1 is at the low level, the third transistor 13 is turned off to initiate charging of the capacitor 15 at the time $t_{50}$.

The output level of the comparator 17 is low until the charging voltage of the capacitor 15 exceeds the voltage at the junction 20, or a reference voltage obtained by dividing the voltage of the battery 3 by the resistors 18 and 19. During the forward rotation of the engine EN, the output level of the starter 51 is high and the output level of the inverter 53 is low, so that the output level of the AND gate 54 is low and the output level of the flip-flop 21 is also low, the forth transistor 24 thus being held in the OFF condition. Even when the sensor 1 senses the second angular position $\theta_2$ of the crank shaft CS and its output level goes high at the time $t_{51}$, the time before the charging voltage of the capacitor 15 exceeds the reference voltage, and the output level of the flip-flop 21 is held unchanged at the low level because the capacitor 15 has been discharged, allowing the fourth transistor 24 to remain OFF. At the time $t_{51}$, therefore, the first transistor 2 turns ON and the second transistor turns OFF to cut off the flow of current through the primary winding of the ignition coil 6, so that a high voltage is generated in the secondary winding thereof to generate a spark at the ignition plug 7.

Assume that after the time $t_{51}$ the switch 52 is held ON to rotate the crank shaft in the forward direction and the sensor 1 again senses the first angular position $\theta_1$ at the time $t_{52}$. The second transistor 5 turns ON as in the previous case, and a current flows through the primary winding of the coil 6 to raise the charging voltage of the capacitor 15. If the charging voltage of the capacitor 15 exceeds the reference voltage at the time $t_{53}$, and the sensor 1 senses the second angular position $\theta_2$ of the crank shaft CS at the time $t_{54}$, and the output level of the comparator 17 becomes high at the time $t_{53}$. On the other hand, the output level of the starter 51 is high and the output level of the inverter 53 is low, and thus the output level of the flip-flop 21 is still low keeping the fourth transistor 24 OFF. At the time $t_{54}$, the output of the sensor goes high and the third transistor 13 turns ON so that the capacitor 15 is discharged and the output of the comparator 17 again goes low to maintain the fourth transistor 24 OFF, while the second transistor 5 turns OFF as previously, thereby generating a spark at the plug 7.

Thereafter, when the switch 52 is open at the time $t_{55}$, the output of the starter 51 changes to low and the output of the inverter 53 to high. As the starter is deenergized, the driving force of the crank shaft CS is reduced. As a result the crank shaft CS, after passing over the first angular position $\theta_1$ at the time $t_{56}$, begins to reversely rotate before the crank shaft passes the second angular position $\theta_2$ and then again passes through the first angular position $\theta_1$ at the time $t_{58}$. When the output level of the sensor 1 goes low at the time $t_{56}$, the second transistor turns ON as in the previous manner, allowing a current to flow through the primary winding of the coil 6. At the same time, the charging of the capacitor 15 is commenced. Since the crank shaft CS gradually slows down to a stop and then rotates reversely, the period between $t_{56}$ and $t_{58}$ is relatively long so that the charging voltage of the capacitor 15 exceeds the reference voltage at the time $t_{57}$ before the time $t_{58}$. The output level of the comparator 17 goes high at the time $t_{57}$. Since the output level of the inverter 53 has already gone high. the output level of the AND gate 54 also goes high to set the flip-flop 21 at the time $t_{57}$. As a result, the output of the flip-flop 21 goes high to hold the fourth transistor 24 ON.

Since the flip-flop 21 continues to be set after the time $t_{57}$, the sensor 1 senses the first angular position $\theta_1$ of the crank shaft CS at the time $t_{58}$ to generate a low output. As previously, since the fourth transistor 24 is held ON while the second transistor 5 is turned OFF, the flow of current passing through the primary winding of the ignition coil 6 is not cut off. Thus the generation of an ignition spark at the ignition plug 7 is prevented after the reverse rotation of the engine EN commences.

Figure 5:
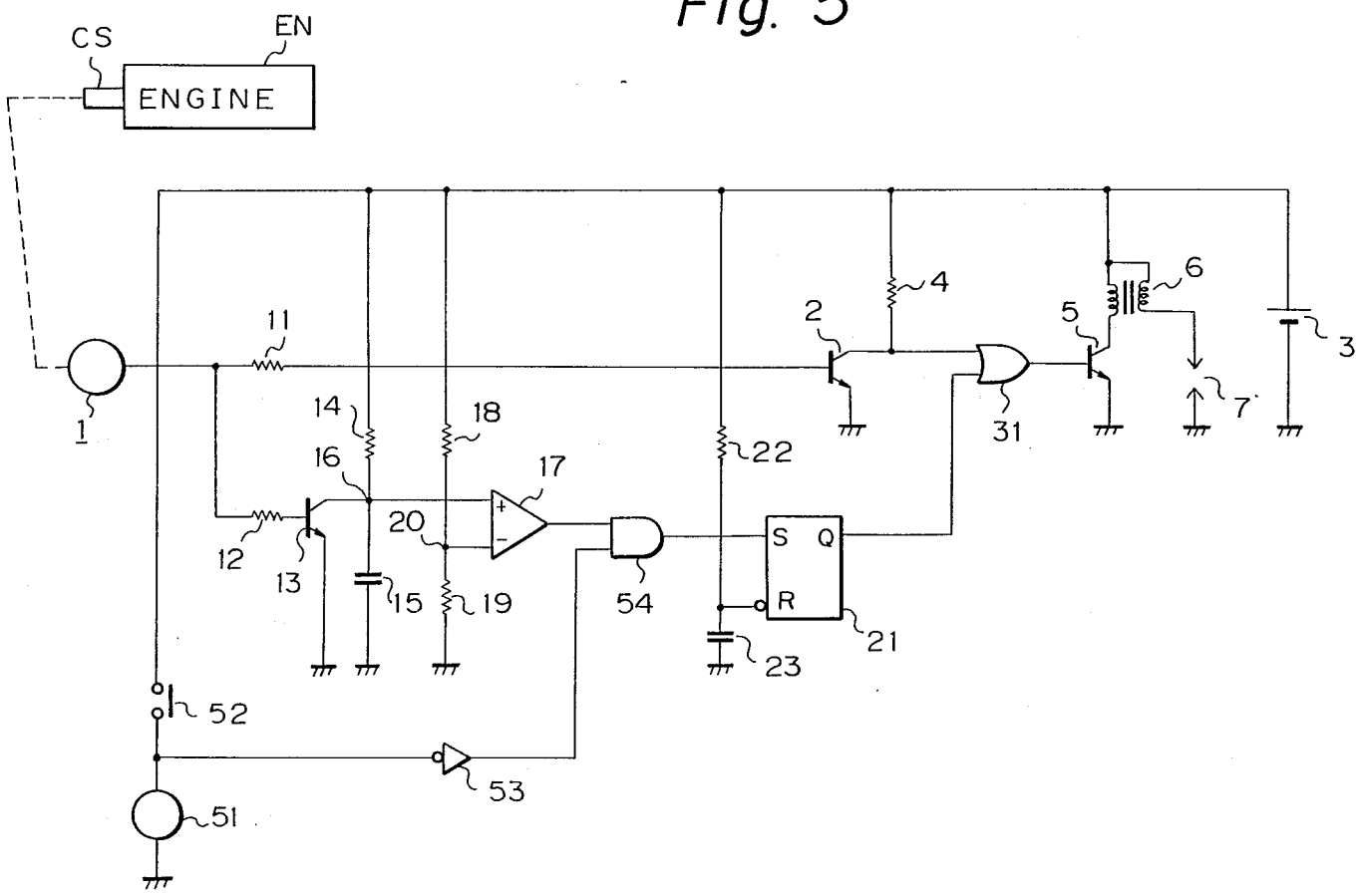
FIG. 5 shows a partly modified example of the circuitry of the ignition apparatus of FIG. 3.

In the ignition apparatus of FIG. 3, it is necessary that the second and fourth transistors 5 and 24 are of high voltage-proof and large current type and this leads to a high cost. As will be understood from the above description regarding the apparatus of FIG. 3, what is necessary to be done upon the reverse rotation of the engine EN is that the flip-flop 21 is set to continue the flow of current through the primary winding of the ignition coil 6. Accordingly, the apparatus of FIG. 3 can be modified in such a manner that the second transistor 5 is turned ON by the set output of the flip-flop 21 irrespective of the output level of the first transistor 2. FIG. 5 shows a circuit diagram of such a modified ignition apparatus in which the collector output of the first transistor 2 and the output of the flip-flop 21 are connected through an OR gate 31 to the base electrode of the second transistor 5.

Figure 6:
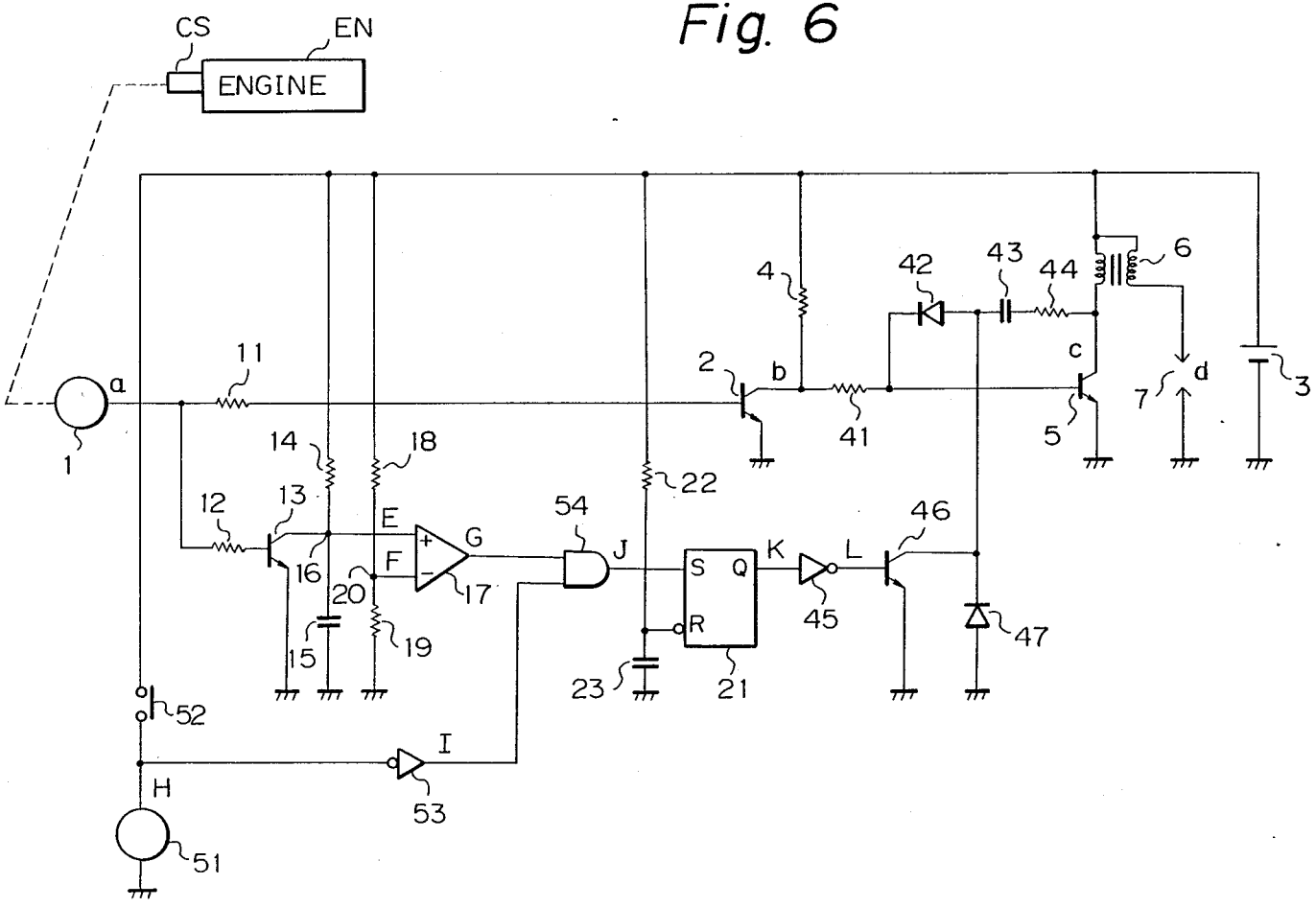
FIG. 6 is a circuit diagram showing the arrangement of another embodiment of the ignition apparatus in accordance with the present invention.

FIG. 6 shows the circuitry of a still further embodiment of the ignition apparatus in accordance with the present invention. In this drawing, elements and components which are similar to those of the apparatus of FIG. 3 are referred to by the same reference signs and numerals and no further description of such elements and components will be given here.

In FIG. 6, the collector electrode of the first transistor 2 is connected through a resistor 41 to the base electrode of the second transistor 5. The base electrode of the second transistor is connected to the anode of a diode 42, the cathode of which is connected to the collector electrode of the second transistor through a second capacitor 43 and a resistor 44 connected in series to the capacitor 43.

On the other hand, the Q output terminal of the flip-flop 21 is connected through an inverter 45 to the base electrode of a fifth transistor 46 the emitter electrode of which is grounded and the collector electrode is connected to the anode of a diode 47 grounded at its cathode. The collector electrode of the fifth transistor is also connected to the junction between the diode 42 and the second transistor 43. It may be possible to eliminate the inverter 45 and instead to directly drive the transistor 46 with the Q output of the flip-flop 21.

Figure 7:
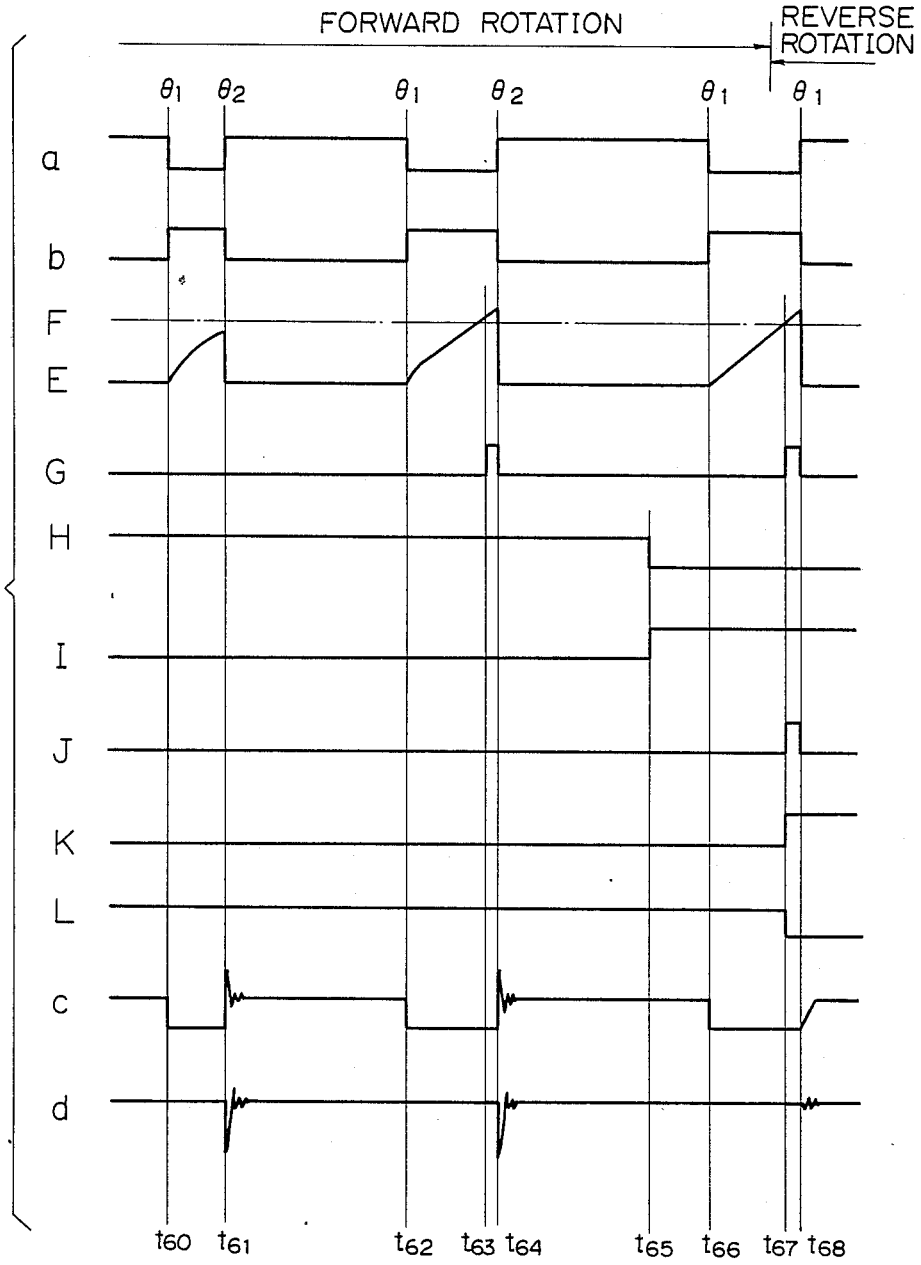
FIG. 7 shows signal waveforms in relation to the timing of outputs from the main portions of the ignition apparatus of FIG. 6.

FIG. 7 shows waveforms of the output voltage at various portions of the apparatus of FIG. 6. In FIG. 7, the reference sign L indicates a waveform of the output voltage of the inverter 45. The voltage waveforms of the portions indicated by the signs a, b, c, d, E, F, G, H, I, J and K are the same as those already described in connection with FIGS. 3 and 4 and no further description thereof will be given. The operation of the apparatus of FIG. 6 will be described below with reference to FIG. 7.

As already described in connection with FIGS. 3 and 4, a driver turns on the switch 52 to energize the starter 51 for starting the engine EN. The crank shaft CS of the engine EN is rotated in the forward direction, and at the time $t_{65}$ the switch 52 is turned OFF to de-energize the starter 51. It is assumed that reverse rotation of the crank shaft CS begins after it has passed through the first angular position $\theta_1$ at the time $t_{66}$. At this time the output level of the sensor 1 is low which serves to turn on the second transistor 5 and a current thus commences flowing through the primary winding of the ignition coil 6 and the charging of the first capacitor 15 also commences.

During the period when the charging voltage of the first capacitor 15 does not exceed the reference voltage (the voltage at the junction 20), the output level of the flip-flop 21 is low and the output level of the inverter 45 is high, so that the fifth transistor 46 is ON. Thus, during the period when the second transistor 5 is OFF, the current for charging the second capacitor 43 flows through the path: the positive terminal of the battery 3→ the primary winding of the ignition coil 6→ the resistor 44→ the second capacitor 43→ the collector electrode of the fifth transistor 46→ the emitter electrode of the fifth transistor 46→ the ground. During the period when the second transistor 5 is ON, the second capacitor 43 is discharged through the path: the ground→the diode 47→ the second capacitor 43→ the resistor 44→ the collector electrode of the second transistor 5→ the emitter electrode of the second transistor 5. Thus, during the period when the charging voltage of the first capacitor 15 does not exceed the reference voltage, the second capacitor 43 does not have any effect on the ON/OFF operation of the second transistor 5.

When the charging voltage of the first capacitor 15 exceeds the reference voltage, the output level of the flip-flop 21 is held high and the output level of the inverter 45 low so that the fifth transistor 46 continues to be OFF. On the other hand, since the second transistor 5 is turned ON after the time $t_{66}$, the charging path of the second capacitor 43 will be changed after the time $t_{67}$ to the path: the positive terminal of the battery 3→ the primary winding of the ignition coil 6→ the resistor 44→ the second capacitor 43→ the diode 42→ the base electrode of the second transistor 5→ the emitter electrode of the second transistor 5→ the ground. Therefore, a negative feedback circuit is formed and the sensor 1 senses the first angular position $\theta_1$ of the crank shaft CS at the time $t_{68}$ to turn the output level of the sensor 1 to high. Accordingly, even when the first transistor turns ON, the second transistor 5 gradually shifts from ON to OFF to slowly cut off the flow of current through the primary winding of the ignition coil 6, thereby preventing a spark from being generated at the ignition plug 7.

In some of the preferred embodiments described above, the following combinations can be used for the sensor which senses the angular positions of the crank shaft CS: (1) the combination of light emitting diodes and a slit disc; (2) the combination of a proximity switch and a rotating rotor; and (3) the combination of a magnetic pick-up and a rotating rotor, etc.

Although the present invention has been described with reference to preferred embodiments, various alterations and modifications can be made without deviating from the spirit and scope of the invention. For example, (1) the flip-flop 21 may be set at the rise time of the output of the sensor 1 rather than at the time of the activation of the power source; (2) a thyristor may be used instead of the flip-flop 21 for holding the output of the comparator 17; (3) the capacitor 15 may be charged with a constant current; and (4) a pulse oscillator and a counter for counting the output pulses thereof may be used instead of the capacitor 15.

What is claimed is:

1. An ignition apparatus for an internal combustion engine started by rotating a rotary member in one direction upon the driving of a starter, having an ignition coil and an ignition plug connected to the ignition coil for the generation of ignition sparks at predetermined intervals of time, said ignition apparatus comprising:

an angle sensing means for sensing first and second angular positions of said rotary members, the output of said sensing means being changed between first and second levels every time each of the angular position is sensed;

an ignition control means coupled to said angle sensing means and said ignition coil and operable to energize said ignition coil during the period of time when the output of said angle sensing means is at said first level and to de-energize said ignition coil to generate a spark at said ignition plug at the time when the output of said angle sensing means goes from said first level to said second level;

a monitoring means for monitoring whether or not a current is flowing through said starter and adapted to generate an output when the current is cup off;

a measuring means coupled to said angle sensing means for measuring the period during which the output of said angle sensing means is held at said first level and adapted to generate an output when said period exceeds a predetermined length of time; and an ignition preventing means responsive to the outputs of said monitoring means and said measuring means and adapted to control said ignition coil so that no ignition spark is generated at said ignition plug, thereby preventing the generation of any spark at said plug when said rotary member rotates reversely.

2. An ignition apparatus as claimed in claim 1, wherein said angle sensing means is provided with an angular position sensor, and said ignition control means includes a transistor connected in series to said ignition coil, said transistor being turned ON during the period when the output of said sensor is at said first level and OFF when the output of said sensor goes to said second level.

3. An ignition apparatus as claimed in claim 2, wherein said measuring means includes a capacitor which starts to be charged at the time when said sensor is turned from said second level to said first level and which is discharged at the time when said sensor is turned from said first level to said second level, and a comparator for comparing the charging voltage of said capacitor with a reference voltage, the magnitude of said reference voltage being set such that the charging voltage of said capacitor exceeds said reference voltage at the lapse of said predetermined length of time, said comparator generating an output when said charging voltage exceeds said reference voltage.

4. An ignition apparatus as claimed in claim 3, wherein said ignition preventing means has an energization means for holding said ignition coil in the energized condition irrespective of the output of said sensor when the outputs of both said monitoring means and said comparator are generated.

5. An ignition apparatus as claimed in claim 4, wherein said energization means comprises an AND gate for receiving the outputs from said comparator and said monitoring means and a flip-flop for holding the output of said AND gate, the output of said AND gate being coupled to the junction between the collector electrode of said transistor and said ignition coil to hold said ignition coil in the energized condition in response to the output of said flip-flop.

6. An ignition apparatus as claimed in claim 5, wherein the outputs of said flip-flop and said sensor are supplied to said transistor through an OR gate.

7. An ignition apparatus as claimed in claim 3, wherein said ignition preventing means has a current reducing means for gradually reducing the flow of current through said ignition coil in response to the fact that said comparator generates an output and that said monitoring means detects the reverse rotation of said starter.

8. An ignition apparatus as claimed in claim 7, wherein said current reducing means includes a series circuit having a capacitor and a resistor connected in series to said capacitor, said series circuit being connected between the collector and base electrodes of said transistor, the capacitor of said series circuit being charged and discharged corresponding to the ON and OFF states of said transistor when the current is flowing through said starter and said series circuit constituting negative feedback circuits between said collector electrode and said base electrode which are adapted to slowly shift said transistor from ON to OFF.

9. An ignition apparatus for an internal combustion engine started by rotating a rotary member in one direction upon the driving of a starter, having an ignition coil and an ignition plug connected to the ignition coil and adapted to generate ignition sparks at a predetermined interval of time, said ignition apparatus comprising:

a sensor means for sensing first and second angular positions of said rotary member, the output of said sensor means being changed between first and second levels every time the respective angular positions are sensed;

a switching means coupled between said sensor means and said ignition coil, said switching means being operable to energize said ignition coil during the period when the output of said sensor means is at said first level and de-energize said ignition coil to generate an ignition spark at said ignition plug when the output of said sensor goes from said first level to said second level;

a monitoring means for monitoring whether or not a current is flowing through said starter and adapted to generate an output when said flow of current is cut off;

a detecting means coupled to said sensor means for generating an output when said detecting means detects the fact that the period during which the output of said sensor means is held at said first level exceeds a predetermined length of time; and a holding means for holding said ignition coil in the energized condition in response to the outputs of said monitoring means and said detecting means, thereby preventing any spark from being generated at said ignition plug when said rotary member is rotated reversely.

10. An ignition apparatus as claimed in claim 9, wherein said detecting means includes a capacitor adapted to initiate the charging at the time when the output of said sensor means changes from said second level to said first level and to discharge at the time when the output of said sensor means changes from said first level to said second level, and a comparator for comparing the charging voltage of said capacitor with a reference voltage, the magnitude of the reference voltage being set such that the charging voltage of said capacitor exceeds said reference voltage when said predetermined length of time has elapsed, said comparator generating an output when said charging voltage exceeds said reference voltage.

11. An ignition apparatus as claimed in claim 10, wherein said holding means comprises an AND gate for receiving the outputs of said comparator and of said monitoring means, and a flip-flop for holding the output of said AND gate, the output of said flip-flop being coupled to the junction between the output terminal of said switching means and said ignition coil for holding the latter in the energized condition in response to the output of said flip-flop.

12. An ignition apparatus as claimed in claim 10, wherein said holding means comprises an AND gate for receiving the outputs of said comparator and of said monitoring means and a flip-flop for holding the output of said AND gate, the output of said flip-flip being supplied through an OR gate to an input terminal of said switching means to hold the latter in the ON condition in response to the output of said flip-flop.

13. An ignition apparatus for an internal combustion engine started by rotating a rotary member in one direction upon the driving of a starter, having an ignition coil and an ignition plug connected to the ignition coil and adapted to generate ignition sparks at a predetermined interval of time, said ignition apparatus comprising:

a sensor means for sensing first and second angular positions, the output thereof being changed between first and second levels every time the respective angular positions are sensed;

a switching means coupled to said sensor means and said ignition coil and operable to be turned ON to energize said ignition coil during the period when the output of said sensor means is at said first level and turned OFF to de-energize said ignition coil to generate a spark at said ignition plug at the time when the output of said sensor means goes from said first level to said second level;

a monitoring means for monitoring whether or not a current is flowing through said starter and adapted to generate an output when such flow of current is cut off;

a detecting means coupled to said sensor means for generating an output when said detecting means detects the fact that the period during which the output of said sensor means is held at said first level exceeds a predetermined length of time; and a de-energization means for gradually changing said ignition coil from the energized condition to the de-energized condition in response to the outputs of said monitoring means and said detecting means to prevent a spark from being generated at said ignition plug when said rotary member is rotated reversely.

14. An ignition apparatus as claimed in claim 13, wherein said detecting means includes a capacitor adapted to initiate the charging at the time when the output of said sensor means changes from said second level to said first level and to discharge at the time when the output of said sensor means changes from said first level to said second level, and a comparator for comparing the charging voltage of said capacitor with a reference voltage, the magnitude of said reference voltage being set such that the charging voltage of said capacitor exceeds said reference voltage when said predetermined length of time has elapsed, said comparator generating an output when said charging voltage exceeds said reference voltage.

15. An ignition apparatus as claimed in claim 14, wherein said de-energization means has a current reducing circuit operable to gradually reduce the flow of current through said ignition coil in response to the fact that said comparator is generating the output and said monitoring means has detected the reverse rotation of said starter.

16. An ignition apparatus as claimed in claim 15, wherein said current reducing means includes a series circuit having a capacitor and a resistor connected in series with said capacitor, said series circuit being connected between the output and input terminals of said switching means, the capacitor of said series circuit being charged and discharged in response to the ON and OFF states of said switching means during the period when a current is flowing through said starter, said series circuit constituting a negative feedback circuit between said input and output terminals of said switching means and being adapted to slowly turn said switching means from ON to OFF when the flow of current through said starter is cut off.

17. An internal combustion engine provided with the ignition apparatus claimed in claim 1.

18. An internal combustion engine provided with the ignition apparatus claimed in claim 9.

19. An internal combustion engine provided with the ignition apparatus claimed in claim 13.

* * * * *